US009874887B2

(12) United States Patent
Yan et al.

(10) Patent No.: US 9,874,887 B2
(45) Date of Patent: Jan. 23, 2018

(54) VOLTAGE REGULATOR WITH ADJUSTABLE FEEDBACK

(75) Inventors: Shouli Yan, Austin, TX (US); Alan Westwick, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 749 days.

(21) Appl. No.: 13/404,981

(22) Filed: Feb. 24, 2012

(65) Prior Publication Data

US 2013/0221937 A1 Aug. 29, 2013

(51) Int. Cl.
*G05F 1/00* (2006.01)
*G05F 1/565* (2006.01)

(52) U.S. Cl.
CPC ..... *G05F 1/565* (2013.01)

(58) Field of Classification Search
CPC . G05F 1/56; G05F 1/575; G05F 1/465; G05F 1/562; G05F 1/565; G05F 1/569; G05F 1/571; G05F 1/573; G05F 1/5735
USPC ..... 323/271, 274, 312, 313, 314, 315, 316; 327/538, 539, 540, 541
See application file for complete search history.

(56) References Cited

U.S. PATENT DOCUMENTS

| | | | | |
|---|---|---|---|---|
| 7,656,139 | B2 * | 2/2010 | van Ettinger | 323/280 |
| 7,723,968 | B2 * | 5/2010 | Okuyama et al. | 323/274 |
| 8,080,984 | B1 * | 12/2011 | Geynet | 323/280 |
| 8,493,043 | B2 | 7/2013 | Le et al. | |
| 8,519,780 | B1 | 8/2013 | Vilas Boas et al. | |
| 8,525,580 | B2 | 9/2013 | Morino et al. | |
| 2007/0247133 | A1 * | 10/2007 | Isobe et al. | 323/312 |
| 2009/0033298 | A1 * | 2/2009 | Kleveland | 323/271 |
| 2011/0102057 | A1 * | 5/2011 | Jurasek et al. | 327/512 |

* cited by examiner

*Primary Examiner* — Nguyen Tran
(74) *Attorney, Agent, or Firm* — Meyertons, Hood, Kivlin, Kowert & Goetzel, P.C.

(57) ABSTRACT

A voltage regulator circuit with variable feedback is disclosed. In one embodiment, a voltage regulator includes an amplifier having a first input configured to receive a reference voltage and a second input configured to receive a feedback signal. The voltage regulator further includes first and second transistors each having respective gate terminals coupled to an output of the amplifier. A resistor network coupled to the second input of the amplifier and further coupled to the first and second transistors. The resistor network is configured to produce the feedback signal based on currents through the first and second transistors, respectively.

21 Claims, 4 Drawing Sheets

VOLTAGE REGULATOR WITH ADJUSTABLE FEEDBACK

BACKGROUND

1. Field of the Invention

This invention relates to electronic circuits, and more particularly, to voltage regulators.

2. Description of the Related Art

Voltage regulators are well known in the art of electronics. A voltage regulator is a circuit configured to maintain an output voltage provided to other circuits within a given range (e.g., ±10%). A circuit receiving a supply voltage via a voltage regulator may be referred to as a load. In various implementations, voltage regulators may provide a supply voltage to one or more loads.

A typical voltage regulator may include a feedback path. Changes to the amount of current drawn by the one or more coupled loads may cause changes to the output voltage provided by a voltage regulator. The change in the output voltage may be reflected in a feedback path. The voltage regulator may respond to the output voltage change by adjusting the output voltage back toward a nominal value and thus within the specified range.

Voltage regulators may be defined by a number of different parameters. Voltage regulation may be defined by load regulation and input regulation. Load regulation reflects a change in the output voltage of the voltage regulator based on a corresponding change in the load current. Line regulation reflects the amount of change of the voltage regulator output voltage responsive to an input voltage. Additional parameters include dropout voltage (minimum difference between the input and output voltages at which a specified current can be supplied), transient response (the ability of the voltage regulator to respond to sudden changes in load current) and so forth.

SUMMARY OF THE DISCLOSURE

A voltage regulator circuit with variable feedback is disclosed. In one embodiment, a voltage regulator includes an amplifier having a first input configured to receive a reference voltage and a second input configured to receive a feedback signal. The voltage regulator further includes first and second transistors each having respective control terminals (e.g., gate terminals) coupled to an output of the amplifier. A resistor network coupled to the second input of the amplifier and further coupled to the first and second transistors. The resistor network is configured to produce the feedback signal based on source terminal voltages of the first and second transistors, respectively.

In one embodiment, a method includes generating an output signal using an amplifier. The output signal is based on a voltage reference signal received at a first amplifier input and a feedback signal received at a second amplifier input. The method further includes producing the feedback signal based on the source terminal voltages of the first and second transistors, respectively, and the output voltage is also the source terminal voltage of the second transistor, wherein each of the first and second transistors include respective gate terminals coupled to the output of the amplifier.

In one embodiment, an integrated circuit includes one or more load circuits and a voltage regulator coupled to provide a supply voltage to the one or more load circuits. The voltage regulator includes an amplifier having a first input configured to receive a reference voltage and a second input configured to receive a feedback signal. The voltage regulator further includes first and second transistors each having respective gate terminals coupled to the output of the amplifier. A resistor network is coupled to the second input of the amplifier and further coupled to the first and second transistors. The resistor network is configured to produce the feedback signal based on source terminal voltages of the first and second transistors, respectively.

BRIEF DESCRIPTION OF THE DRAWINGS

Other aspects of the disclosure will become apparent upon reading the following detailed description and upon reference to the accompanying drawings, which are now described as follows.

Figure 1:
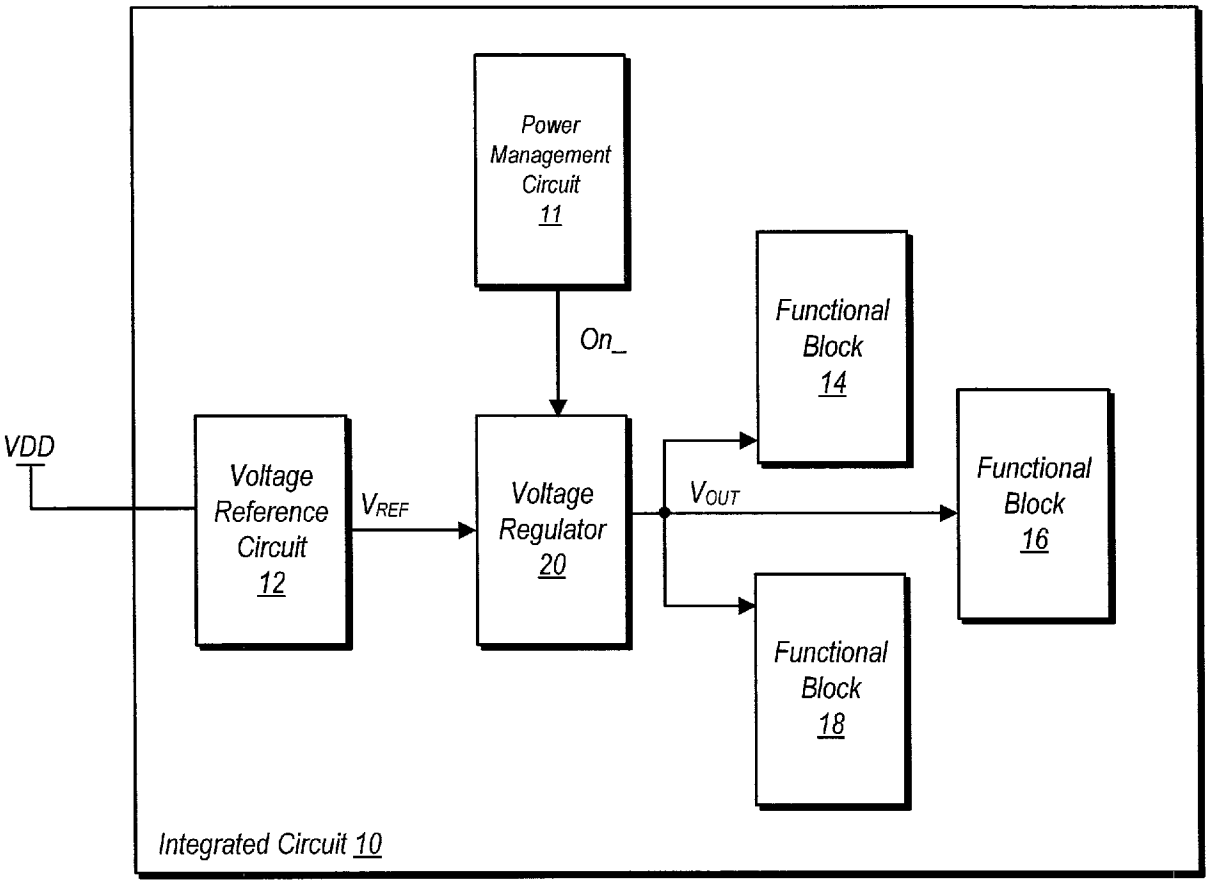
FIG. 1 is a block diagram of one embodiment of an integrated circuit.

While the invention is susceptible to various modifications and alternative forms, specific embodiments thereof are shown by way of example in the drawings and will herein be described in detail. It should be understood, however, that the drawings and description thereto are not intended to limit the invention to the particular form disclosed, but, on the contrary, the invention is to cover all modifications, equivalents, and alternatives falling within the spirit and scope of the present invention as defined by the appended claims.

DETAILED DESCRIPTION

Turning now to FIG. 1, a block diagram of an integrated circuit is shown. In the embodiment shown, integrated circuit 10 includes functional blocks 14, 16, and 18. Each of functional blocks 14, 16, and 18 may be any type of circuitry that performs one of the intended functions of the integrated circuit. The circuitry in a given functional block may be analog, digital, or mixed signal circuitry. Exemplary circuit types include interface circuits, processor cores, graphics circuitry, radio frequency transceivers, and so forth. In general, a functional block as discussed herein may be any type of circuitry that can be implemented on an integrated circuit. The number of functional blocks on a given embodiment of integrated circuit 10 may vary, and may be as few as one.

Each of functional blocks 14, 16, and 18 in the embodiment shown is coupled to receive a supply voltage from voltage regulator 20. In turn, voltage regulator 20 may receive a reference voltage from voltage reference circuit 12, which is coupled to receive a voltage VDD from a source external to integrated circuit 10. Without loss of generality, in other embodiments, the voltage provided by the source external to integrated circuit 10 may be labeled "VCC" or otherwise, as persons of ordinary skill in the art understand. Voltage reference circuit may generate a reference voltage, $V_{REF}$, to be provided to voltage regulator 20. In some embodiments, the reference voltage may be the same as VDD, and thus voltage reference circuit 12 may be eliminated.

Integrated circuit 10 also includes a power management circuit 11. In the embodiment shown, power management circuit 11 is coupled to provide an active low signal, On_, to voltage regulator 20. Although not explicitly shown, power management circuit 11 may also provide similar signals to functional blocks 14, 16, and 18 in order to implement the ability to selectively power these blocks down when idle. If all functional blocks are idle, power management circuit 11 may de-assert the On_signal to power down voltage regulator 20 as well. It is noted that power management unit circuit 11, and its various connections to other functional blocks, are optional, and may not be present in all embodiments.

The supply voltage, $V_{OUT}$, may be regulated (i.e., maintained) within a specified range by voltage regulator 20. Each of the functional blocks 14, 16, and 18 may draw load current at a voltage within the specified range from voltage regulator 20. The amount of load current drawn by a given one of functional blocks 14, 16, and/or 18 may change over time. In some instances, the change of current may be very rapid. For example, an exemplary functional block implementing digital circuitry may be subject to a rapid change in load current due to the enabling or disabling of a high frequency clock provided to the block. Such a simultaneous switching can cause a significant decrease or increase in the amount of current drawn. Changes to the amount of current drawn by a given one (or more than one) of functional blocks 14, 16, and 18 can cause corresponding changes to the voltage supplied by voltage regulator 20. As explained in further detail below, voltage regulator 20 may use the changing current demands to generate feedback in order to adjust and maintain its output voltage within a specified range.

Figure 2:
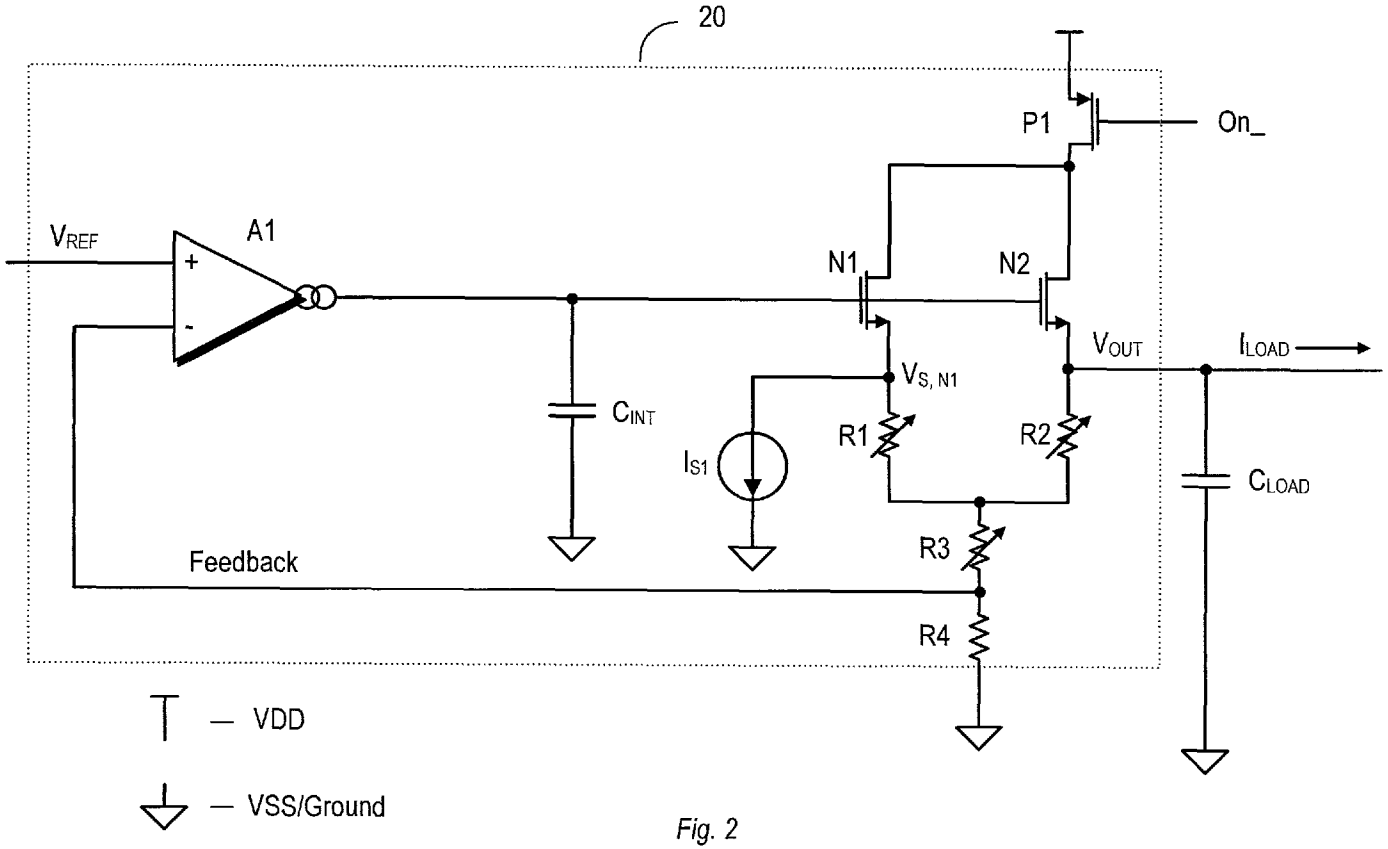
FIG. 2 is a schematic diagram of one embodiment of a disclosed voltage regulator.

Turning now to FIG. 2, a schematic diagram of one embodiment of voltage regulator 20 is shown. In the embodiment shown, amplifier A1 is a transconductance amplifier coupled to receive a reference voltage on its non-inverting input and a feedback signal on its inverting input. Since amplifier A1 is a transconductance amplifier in this embodiment, it is thus sensitive to changes in voltage difference between its non-inverting and inverting inputs. It is noted however that embodiments using other types of amplifiers are possible and contemplated.

In the embodiment shown, transistors N1 and N2 include respective gate terminals that are coupled to the output of amplifier A1. In some embodiments (not shown), additional circuitry may be implemented between the gate terminals of transistors N1 and N2 and the output of amplifier A1, although the transistors may nevertheless be responsive to changes to the amplifier output (and are thus effectively coupled to the amplifier output). In other embodiments, such as the one shown in FIG. 2, the output of amplifier A1 is directly coupled to the gate terminals of transistors N1 and N2.

In the embodiment shown, an internal capacitance, $C_{INT}$, is coupled between the output of amplifier A1 and $V_{SS}$ (which may be alternately be a ground node, or more generally, a return node). This capacitance may be implemented using one or more capacitors. Capacitance $C_{INT}$ may provide some decoupling and may thus limit noise that may occur on the output of amplifier A1. In some embodiments, capacitance $C_{INT}$ may also provide frequency compensation to improve the stability of voltage regulator 20.

It is noted that in the embodiment shown, transistors N1 and N2 are n-channel metal oxide semiconductor (NMOS) transistors. Embodiments of voltage regulator 20 implemented with p-channel metal oxide semiconductor (PMOS) transistors, bi-polar transistors, and transistors based on other semiconductor materials, graphene ribbons or carbon nanotubes are also possible and contemplated.

Voltage regulator 20 includes a resistor network in the embodiment shown. One resistor in the resistor network, R3, is coupled between the inverting input of amplifier A1 and each of resistors R1 and R2. Resistor R1 in the embodiment shown is coupled between the source terminal of transistor N1 and resistor R3. Resistor R2 is coupled between the source terminal of transistor N2 and resistor R3. In the embodiment shown, each of resistors R1, R2, and R3 are variable resistors. The settings (adjusted or set values) for resistors R1 and R2 may in part determine the relative contributions of N1 and N2 source terminal voltages to the feedback signal. The setting of resistor R3 may also determine at least in part the magnitude of the feedback signal. It is noted that in some embodiments, resistors R1, R2, and R3 may have fixed values instead of variable values as shown here. In some embodiments, current source $I_{S1}$ in FIG. 2 provides additional bias current for NMOS device N1, with additional freedom to set the DC operating point of N1. In some embodiments, current source $I_{S1}$ can be omitted without affecting the general working principle. In some embodiments, R3 can be chosen to have a zero value, and effectively be replaced with a short circuit.

The output node of voltage regulator 20 in this embodiment is taken from the source node of transistor N2. The source terminal of transistor N1 is not directly coupled to the output node. Decoupling the source terminal of transistor N1 from the output node as shown in FIG. 2 may provide at least some isolation of N1 from the load capacitance ($C_{LOAD}$). Accordingly, transistor N1 may be less responsive to changes to the load current, $I_L$, than it would if its source were directly coupled to the output node. On the other hand, changes to the load current may have a more pronounced affect on the amount of current through transistor N2 and resistor R2, since the source terminal of transistor N2 is directly coupled to the output node (and thus to the one or more load circuits receiving voltage from the voltage regulator). The adjustability of resistors R1 and R2 may provide a continuum between operating points in which R2 is effectively eliminated from the circuit ($R2 \approx \infty$) and in which R1 is effectively eliminated from the circuit ($R1 \approx \infty$). This will be discussed in further detail below with reference to FIG. 4.

The resistance settings selections or adjustments (we refer to adjusting below) for each of resistors R1, R2, and R3 may be performed in various ways. In one embodiment, the setting of resistors R1, R2, and R3 may be performed at the end of a manufacturing process, and may be based on a characterization performed to determine optimal values for a wide variety of applications. In another embodiment, a characterization process may be performed to determine the optimum values for a specific application in which voltage regulator 20 is to be used. Both of these methods may be performed prior to installation of an integrated circuit including voltage regulator 20 into a system. In yet another embodiment, a characterization self-test may be performed during an initialization of system that includes an integrated circuit implementing voltage regulator 20. In such a system, the resistance values of R1, R2, and R3 may be set at run time. In general, the setting and adjusting of resistors R1, R2, and R3 may be performed in any manner suitable for a particular application, and is thus not limited to those examples explicitly disclosed herein. Since resistors R1, R2, R3 and R4 perform a voltage divider function in the embodiment shown, an important parameter may be the ratios between their respective resistance values (rather than the individual resistance values themselves). In the embodiment shown, the ratios may be adjusted by holding the resistance of R4 constant while adjusting respective resistances of R1, R2, and/or R3. In other embodiments, all four resistors shown may by implemented as adjustable resistors. In still further embodiments, one or more of R1, R2, and R3 may have fixed resistance values while the resistance value of R4 is adjustable.

During operation of voltage regulator 20, changes to the load current caused by changes in a demand from a load may in turn cause at least an initial change to the output voltage, $V_{OUT}$. As a result of a change of the output voltage, the current through at least transistor N2 and resistors R2 and R3 may change. When the current through R3 changes, the voltage on the feedback node, and thus on the inverting input of amplifier A1 also changes. The output voltage provided by amplifier A1 may correspondingly change responsive to changes in the voltage of the feedback signal, since the inverting input of amplifier A1 responds to voltage changes in this embodiment. The respective gate terminals of transistors N1 and N2 may receive the changing voltage from amplifier A1, and thus these devices may respond accordingly. More particularly, the current through transistors N1 and N2 may change, and may thus cause changes to both the feedback signal as well as the output voltage. The output voltage response may be such that it remains within a specified range, and in some embodiments, may return to its initial value prior to the change in load current.

In the embodiment shown, voltage regulator 20 includes a transistor P1 that may be utilized for power-gating purposes. Transistor P1 in the embodiment shown is coupled to receive the On_signal, which is active low. When the On_signal is asserted as a low logic level, transistor P1 is active and thus the voltage VDD (or a voltage close to VDD) is provided to the drain terminals of both transistors N1 and N2. When the On_signal is de-asserted (high logic level), transistor P1 may be inactive, and voltage regulator 20 may be effectively powered down. It is noted that transistor P1 is optional, and thus embodiments in which the drain terminals of transistors N1 and N2 are directly connected to a voltage source are possible and contemplated. Furthermore, embodiments in which power-gating functionality is implemented using one or more NMOS transistors instead of the PMOS transistor shown in this embodiment are also possible and contemplated.

Figure 3:
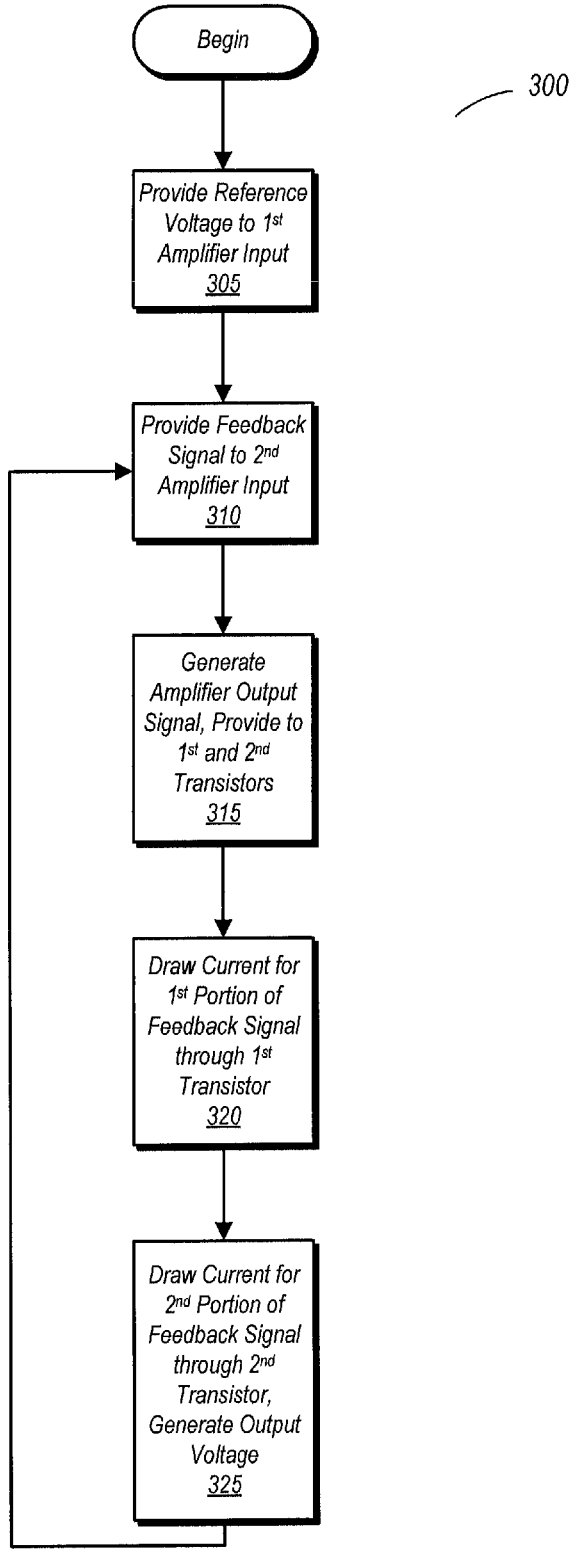
FIG. 3 is a flow diagram illustrating one embodiment of a method for regulating a supply voltage within a specified range.

FIG. 3 is a flow diagram illustrating one embodiment of a method for operating a voltage regulator such as voltage regulator 20 shown in FIG. 2. It is noted that the order in which various blocks of method 300 are presented herein is not intended to imply a specific order of operation. In contrast, the operation discussed in each of the blocks may be performed concurrently with the operation performed in the other blocks.

Method 300 includes the providing of a reference voltage to a first input of an amplifier implemented in a voltage regulator (block 305). In one embodiment, the reference voltage may be a supply voltage received from a source external to an integrated circuit in which the voltage regulator is implemented. In another embodiment, a voltage reference circuit may be implemented on the integrated circuit and coupled to provide the reference voltage to the first input of the amplifier.

Method 300 further includes providing a feedback signal to a second input of the amplifier (block 310). The feedback signal may be generated at least in part based on the output voltage provided by the voltage regulator. An additional portion of the feedback signal may be generated based on a source terminal voltage of a transistor that is not directly coupled to the output node of the voltage regulator.

The amplifier may generate an amplifier output signal based on the received reference voltage and feedback signal, and this signal may be provided to gate terminals of first and second transistors (block 315). The first transistor is not directly coupled to the output voltage node of the voltage regulator. In this embodiment, a source terminal of the first transistor is coupled to the output through R1 and R2 and corresponding intermediate nodes. The second transistor may have a terminal that is directly coupled to the output voltage node. The current through both the first and second transistors may be based at least in part on the voltage of the amplifier output signal. A first portion of the feedback signal may be generated based on the current drawn through the first transistor (block 320). A second portion of the feedback signal, as well as the output voltage, may be generated based on current drawn through the second transistor (block 325). The output voltage may be provided to one or more load circuits, while the feedback signal may be provided to the second amplifier input (block 325).

Figure 4:
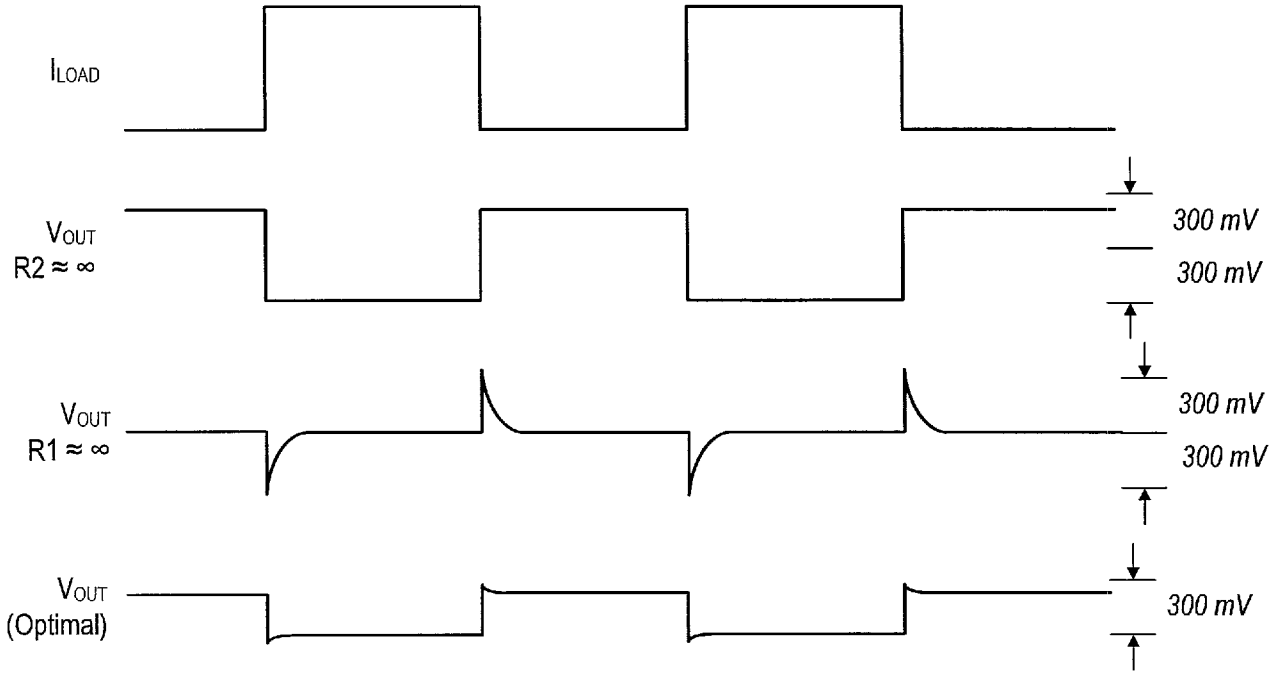
FIG. 4 is a drawing illustrating waveforms generated by one embodiment of a voltage regulator responsive to changes in a load current.

FIG. 4 illustrates waveforms generated by one embodiment of a voltage regulator responsive to changes in a load current based on different configurations. The waveforms in this example are shown in the time domain for clarity. For the purposes of this example, it is assumed that the specified voltage range for $V_{OUT}$ is 300 mV (i.e. the difference between the maximum and minimum rated $V_{OUT}$ operating voltages is 300 mV). It is noted that this value is exemplary and is not intended to be limiting. Any suitable range of voltage values may be used for a given embodiment.

The changes in the load current, $I_{LOAD}$, is shown at the top of the drawing. As noted above, the load current may undergo sudden and significant shifts during operation, and such shifts can cause changes to the output voltage $V_{OUT}$ provided by the voltage regulator.

The second waveform in the drawing illustrates the change in the output voltage, $V_{OUT}$, responsive to the illustrated change in the load current when the resistance of resistor R2 large enough that it is effectively infinite while the resistance of R1 is a finite value. When the resistance of R2 is effectively infinite, the feedback loop is completely isolated from the output voltage node, $V_{OUT}$. Accordingly, the load at $V_{OUT}$, including the explicit $C_{LOAD}$ in FIG. 2 and potentially additional load capacitance from the load circuitry, does not affect the stabilities of the feedback loop, and thus feedback stability can be readily achieved, as there is no additional phase shift of the feedback signal (labeled as "Feedback" in FIG. 2) contributed by the load impedance. However, the feedback signal is not responsive to changes in the load current. Accordingly, the output voltage may undergo significant changes responsive to a change in the load current, LOAD, and such changes may exceed the 300 mV range specified for this example. In this case, the source voltage of N1, $V_{S,N1}$, is given by the following expression, $$V_{S,N1} = \left(1 + \frac{R_1 + R_3}{R_4}\right)V_{REF},$$

where we assume the amplifier A1 in FIG. 2 has infinite DC voltage gain. The output voltage regulator 20, $V_{OUT}$, is approximately equal to the source voltage of N1, $V_{S,N1}$, when the current densities through N1 and N2 are approximately equal. However, when lower/higher load current flowing through N2, less/more voltage drop will develop at the source terminal of N2, which is not regulated by the feedback loop, and hence the relatively large $V_{OUT}$ change with respect to $I_{LOAD}$ results, as depicted in the second waveform of FIG. 4. It should be noted that in this case, when the resistance of R2 is large enough that it is effectively infinite and the resistance of R1 is finite, the load capacitor $C_{LOAD}$ is not part of the feedback loop, and this configuration is generally more stable as a result.

The third waveform in the drawing illustrates the change in the output voltage responsive to the illustrated change in the load current when the resistance of resistor R1 is large enough that it is effectively infinite while the resistance of R2 is a finite value. In this configuration, the first transistor (e.g., N1 of FIG. 2) is effectively eliminated from the voltage regulator. Furthermore, the voltage on the feedback node is directly proportional to the output voltage, with the proportionality constant determined by the ratio between the resistance of R4 and the combined resistances of R2 and R3. In this case, if the amplifier A1 has infinite DC gain, the output voltage of the regulator, $V_{OUT}$, is given by, $$V_{OUT} = \left(1 + \frac{R2 + R3}{R}\right)V_{REF}.$$

Accordingly, the feedback loop in this configuration is highly responsive to changes in the load current, although a time delay through the feedback path may allow the output voltage to change by a substantial amount before the voltage regulator adapts to the new load current and restores the output voltage to the desired value. Responsive to a sudden increase in load current as shown in FIG. 4, the output voltage of the voltage regulator may initially exhibit a significant and sudden droop before returning to its previous value. Similarly, responsive to a sudden drop in the load current, the output voltage may exhibit a significant overshoot before settling back to its original level. In both the case of the droop and the overshoot, the voltage variation may be such that the rated voltage of 300 mV is exceeded. The magnitude of the droop and the overshoot may be reduced by increasing the speed (or bandwidth) of the feedback path, which may be achieved by various means, including reducing the value of $C_{INT}$. However, doing so may cause the voltage regulator to become unstable, particularly when the load capacitance $C_{LOAD}$ has a large value. In this embodiment, the stability is degraded when the ratio of $C_{LOAD}$ to $C_{INT}$ is increased. Note that due to additional delay or phase lag due to the load capacitance, $C_{LOAD}$, this configuration may be prone to instability and additional care in the design or extra power consumption may result to ensure stable operation of the regulator.

The fourth and final waveform shown in FIG. 4 illustrates a configuration in which both resistors R1 and R2 are set at finite values for optimal operation of the voltage regulator. In this particular configuration, the operating point of the voltage regulator is somewhere on the continuum between the points in which R1 and N1 are effectively eliminated from the circuit, and in which R2 is effectively eliminated from the circuit. In the configuration in which both resistors R1 and R2 are set to finite values, the responsiveness of the feedback loop to changes in the load current is reduced relative to the configuration discussed in which the resistance of R1 is large enough that it is effectively infinite. However, the feedback loop is not isolated from changes in the load current as in the configuration in which the resistance of R2 is large enough that it is effectively infinite. By varying relative resistance values of R1 and R2, we can adjust the $V_{S,N1}$ and $V_{OUT}$ contributions to the feedback signal at "Feedback" node in FIG. 2, with output waveform somewhere between extreme cases of the second and the third waveforms shown in FIG. 4, and the stability of the feedback loop also varies between the extreme cases when either R2≈infinity or R1≈infinity. Accordingly, an optimal value between these two endpoints for a given application may be found. The contribution of each resistor to the feedback signal may be set in order to provide the desired stability and control of the output voltage by the voltage regulator. Resistor R3 may provide an additional degree of flexibility in balancing the contributions of R1 and R2 to the feedback signal, and ease the programmability/trimability of the output voltage ($V_{OUT}$) of the regulator over a certain range. In this manner, varying the resistance of R3 could change the absolute values of the output voltage ($V_{OUT}$) of the regulator. And varying relative values of R1 and R2, while keeping R1*R2/(R1+R2) relatively constant, could vary the output voltage ($V_{OUT}$) change with respect to the load current ($I_{LOAD}$) change, or $\Delta V_{OUT}/\Delta I_{LOAD}$, namely, the incremental output resistance of the regulator. Note that incremental output resistance of the regulator can be approximately expressed as $$r_{out} = \frac{\Delta V_{OUT}}{\Delta I_{OUT}} = \frac{1}{gm_2}\frac{R2}{R_1 + R_2 + 1/gm_1},$$

where $gm_1$ and $gm_2$ are transconductances of N1 and N2 respectively in FIG. 2, and wherein it is assumed that amplifier A1 in FIG. 2 has infinite DC voltage gain.

In the waveform shown for the optimal configuration, the output voltage may vary some with the changes in the load current. Furthermore, voltage droops and overshoot may be present. However, the output voltage change and the severity of the droops and spikes overshoots may be minimized, and thus the output voltage may remain within its specified range of 300 mV.

While the present invention has been described with reference to particular embodiments, it will be understood that the embodiments are illustrative and that the invention scope is not so limited. Any variations, modifications, additions, and improvements to the embodiments described are possible. These variations, modifications, additions, and improvements may fall within the scope of the inventions as detailed within the following claims.

What is claimed is:

1. A circuit comprising:

an amplifier having a first input configured to receive a reference voltage and a second input configured to receive a feedback signal;

first and second transistors each having respective control terminals coupled directly to an output of the amplifier; and a resistor network coupled to the second input of the amplifier and further coupled to the first and second transistors, wherein the resistor network is configured to produce the feedback signal responsive to currents through the first and second transistors;

wherein the resistor includes:

a first variable resistor that is adjustable to set a first contribution to the feedback signal by a source voltage of the first transistor; and a second variable resistor that is adjustable to set a second contribution to the feedback signal by an output voltage of the circuit;

wherein the first and second variable resistors are adjustable to provide a continuum of operating points between a first operating point in which a resistance of the first variable resistor is effectively infinite and a second operating point in which a resistance of the second variable resistor is effectively infinite.

2. The circuit as recited in claim 1, wherein the circuit includes an output node coupled to a source terminal of the second transistor, wherein the circuit is configured to maintain a voltage on the output node within a specified range.

3. The circuit as recited in claim 2, wherein a source terminal of the first transistor is coupled to the output node through one or more intermediate nodes.

4. The circuit as recited in claim 1, wherein the resistor network includes a first resistor coupled between the second input of the amplifier and a return node, a second resistor coupled to a source terminal of the first transistor, and a third resistor coupled to a source terminal of the second transistor, wherein the second and third resistors are further coupled to one another and to the second input of the amplifier.

5. The circuit as recited in claim 4, wherein the second and third resistors are variable resistors.

6. The circuit as recited in claim 5, wherein the first resistor is a variable resistor.

7. The circuit as recited in claim 1, wherein the amplifier is a transconductance amplifier.

8. The circuit as recited in claim 1, further comprising a third transistor coupled between a supply voltage and the first and second transistors, wherein the first and second transistors are configured to receive the supply voltage when the third transistor is active.

9. A method comprising:

generating, using an amplifier, an output signal based on a voltage reference signal received at a first amplifier input and a feedback signal received at a second amplifier input;

producing the feedback signal based on currents flowing through first and second transistors, respectively, based on the output signal, wherein each of the first and second transistors include respective control terminals coupled directly to an output of the amplifier; wherein producing the feedback signal comprises:

a first variable resistor providing a first contribution to the feedback signal based on a source voltage of the first transistor;

a second variable resistor providing a second contribution to the feedback signal based on an output voltage of a voltage regulator circuit that includes the amplifier and the first and second transistors;

wherein the first and second variable resistors are adjusted to one of a continuum of operating points between a first operating point in which a resistance of the first variable resistor is effectively infinite and a second operating point in which a resistance of the second variable resistor is effectively infinite.

10. The method as recited in claim 9, further comprising a resistor network drawing current of the feedback signal through the first and second transistors, respectively, wherein the resistor network is coupled to the second amplifier input and further coupled to the first and second transistors.

11. The method as recited in claim 10, wherein the resistor network includes a first resistor coupled between the second input of the amplifier and a return node, a second resistor coupled to a source terminal of the first transistor, and a third resistor coupled to a source terminal of the second transistor, wherein the second and third resistors are further coupled to one another and to the second input of the amplifier.

12. The method as recited in claim 9, further comprising regulating an output voltage within a specified range, wherein the output voltage is provided on a source terminal of the second transistor.

13. The method as recited in claim 9, further comprising the amplifier varying an output current responsive to a change in a relationship between the feedback signal and the voltage reference signal.

14. An integrated circuit comprising:

one more load circuits; and a voltage regulator coupled to generate and provide a supply voltage to the one or more load circuits, wherein generating the supply voltage includes:

an amplifier generating an amplifier output voltage based on a difference between a reference voltage and a feedback signal;

providing the amplifier output voltage directly to respective control terminals of first and second transistors;

generating the feedback signal, wherein a voltage of the feedback signal is based on currents flowing through the first and second transistors and through resistors of a resistor network; and generating the supply voltage based on current flowing through the second transistor and a correspondingly coupled portion of the resistor network;

wherein the resistor network includes:

a first variable resistor to set a first contribution to the feedback signal by a source voltage of the first transistor; and a second variable resistor to set a second contribution to the feedback signal by an output voltage of the voltage regulator;

wherein the first and second variable resistors are adjustable to provide a continuum of operating points between a first operating point in which a resistance of the first variable resistor is effectively infinite and a second operating point in which a resistance of the second variable resistor is effectively infinite.

15. The integrated circuit as recited in claim 14, wherein the voltage regulator is configured to regulate the supply voltage within a specified range.

16. The integrated circuit as recited in claim 15, wherein the voltage regulator includes an output node from which the supply voltage is provided, wherein the output node is coupled to a terminal of the second transistor.

17. The integrated circuit as recited in claim 16, wherein the first transistor is coupled to the output node through one or more intermediate nodes.

18. The integrated circuit as recited in claim 14, wherein the resistor network includes a first resistor coupled between the second input of the amplifier and a return node, a second resistor coupled to a terminal of the first transistor, and a third resistor coupled to a terminal of the second transistor, wherein the second and third resistors are further coupled to one another and to the second input of the amplifier.

19. The integrated circuit as recited in claim 18, wherein the second and third transistors are variable resistors.

20. The integrated circuit as recited in claim 14, wherein the amplifier is a transconductance amplifier.

21. The circuit as recited in claim 1, further comprising a third variable resistor to set a magnitude of the feedback signal, wherein the third variable resistor is coupled to the first and second variable resistors at a feedback node coupled to provide the feedback signal to the amplifier.

* * * * *